US008388103B2

(12) United States Patent
Kiuchi et al.

(10) Patent No.: US 8,388,103 B2
(45) Date of Patent: Mar. 5, 2013

(54) FLUSHING APPARATUS FOR INKJET PRINTER

(75) Inventors: Takashi Kiuchi, Tomi (JP); Hiroyoshi Takano, Tomi (JP)

(73) Assignee: Mimaki Engineering Co., Ltd., Tomi (JP)

( * ) Notice: Subject to any disclaimer, the term of this patent is extended or adjusted under 35 U.S.C. 154(b) by 0 days.

(21) Appl. No.: 13/349,001

(22) Filed: Jan. 12, 2012

(65) Prior Publication Data

US 2012/0113187 A1 May 10, 2012

Related U.S. Application Data

(63) Continuation of application No. PCT/JP2010/057899, filed on May 10, 2010.

(30) Foreign Application Priority Data

Jul. 14, 2009 (JP) ..... 2009-165707

(51) Int. Cl.
*B41J 2/165* (2006.01)

(52) U.S. Cl. ..... 347/34

(58) Field of Classification Search ..... None
See application file for complete search history.

(56) References Cited

U.S. PATENT DOCUMENTS 6,017,109 A * 1/2000 Saijo ..... 347/30
6,540,322 B2 * 4/2003 Usui et al. ..... 347/29
6,918,650 B2 * 7/2005 Umeda et al. ..... 347/30
2002/0041303 A1 4/2002 Yoshinaga
2008/0143781 A1 * 6/2008 Inoue et al. ..... 347/34

FOREIGN PATENT DOCUMENTS

JP 2009-229423 8/2000
JP 2002-187261 7/2002
JP 2008-229966 10/2008
JP 2009-101609 5/2009

OTHER PUBLICATIONS

International Search Report for International Application No. PCT/JP2010/057899, Jun. 15, 2010.

* cited by examiner

*Primary Examiner* — Matthew Luu
*Assistant Examiner* — Alejandro Valencia
(74) *Attorney, Agent, or Firm* — Ditthavong Mori & Steiner, P.C.

(57) ABSTRACT

A flushing apparatus includes a suction mechanism and an ink mist collecting mechanism. The suction mechanism is to suck ink mist. The ink mist collecting mechanism is to collect the ink mist by a suction force of the suction mechanism. The ink mist collecting mechanism includes an upper face part and a droplet forming member. The ink ejected from the nozzle is dropped on the upper face part. The upper face part includes a plurality of suction holes through which the ink mist is sucked into an inside of the ink mist collecting mechanism by the suction force of the suction mechanism. The droplet forming member is provided at a position corresponding to the plurality of the suction holes to provide droplets from the ink mist sucked through the plurality of the suction holes.

14 Claims, 7 Drawing Sheets

FLUSHING APPARATUS FOR INKJET PRINTER

CROSS-REFERENCE TO RELATED APPLICATIONS

The present application is a continuation application of International Application No. PCT/JP2010/057899, filed May 10, 2010, which claims priority to Japanese Patent Application No. 2009-165707, filed Jul. 14, 2009. The contents of these applications are incorporated herein by reference in their entirety.

BACKGROUND OF THE INVENTION

1. Field of the Invention

The present invention relates to a flushing apparatus for an inkjet printer.

2. Discussion of the Background

In an inkjet printer, during a standby time when an image printing or the like is not performed on a medium, which is a printing target, it may be occurred that ink is dried or its viscosity is increased in an inside of a nozzle of an inkjet head and, as a result, the nozzle is clogged. In order to prevent this problem, a flushing processing is performed in the inkjet printer, in other words, ink is periodically ejected from a nozzle of an inkjet head for preventing ink from being dried and for preventing its viscosity from being increased.

When a flushing processing is performed, so-called ink mist which is a fog state ink ejected from the nozzle is generated. The ink mist is easy to be scattered because its particle size is very small and thus the ink mist may stick to the medium, which is a printing target, the inkjet head, the inside of the inkjet printer and the like. Especially, when the mist sticks to a nozzle face of the inkjet head and the mist grows to a lump of ink, image failure such as nozzle's irregular ejection may occur.

In order to prevent this problem, a mechanism for collecting ink mist has been conventionally provided in an inkjet printer. For example, an inkjet printer described in Japanese Patent Laid-Open No. 2009-101609 is provided with an idle ejection receiving part having an adsorbing body for adsorbing ink and a fan. In the inkjet printer, when ink is ejected to the inside of the idle ejection receiving part in a flushing processing, the ejected ink is absorbed by the absorbing body and ink mist having been floated which is generated when the ink is ejected from the nozzle is sucked by the fan to make the ink mist stick to a rear side of the paper and, in this manner, scattering of the ink mist is restrained.

SUMMARY OF THE INVENTION

According to one aspect of the present invention, a flushing apparatus for an inkjet printer includes a suction mechanism and an ink mist collecting mechanism. The suction mechanism is to suck ink mist generated at a time of a flushing processing in which ink is ejected from a nozzle provided in an inkjet head of the inkjet printer. The ink mist collecting mechanism is to collect the ink mist by a suction force of the suction mechanism. The ink mist collecting mechanism has a box shape. The ink mist collecting mechanism includes an upper face part and a droplet forming member. The ink ejected from the nozzle is dropped on the upper face part. The upper face part includes a plurality of suction holes through which the ink mist is sucked into an inside of the ink mist collecting mechanism by the suction force of the suction mechanism. The droplet forming member is provided at a position corresponding to the plurality of the suction holes to provide droplets from the ink mist sucked through the plurality of the suction holes.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
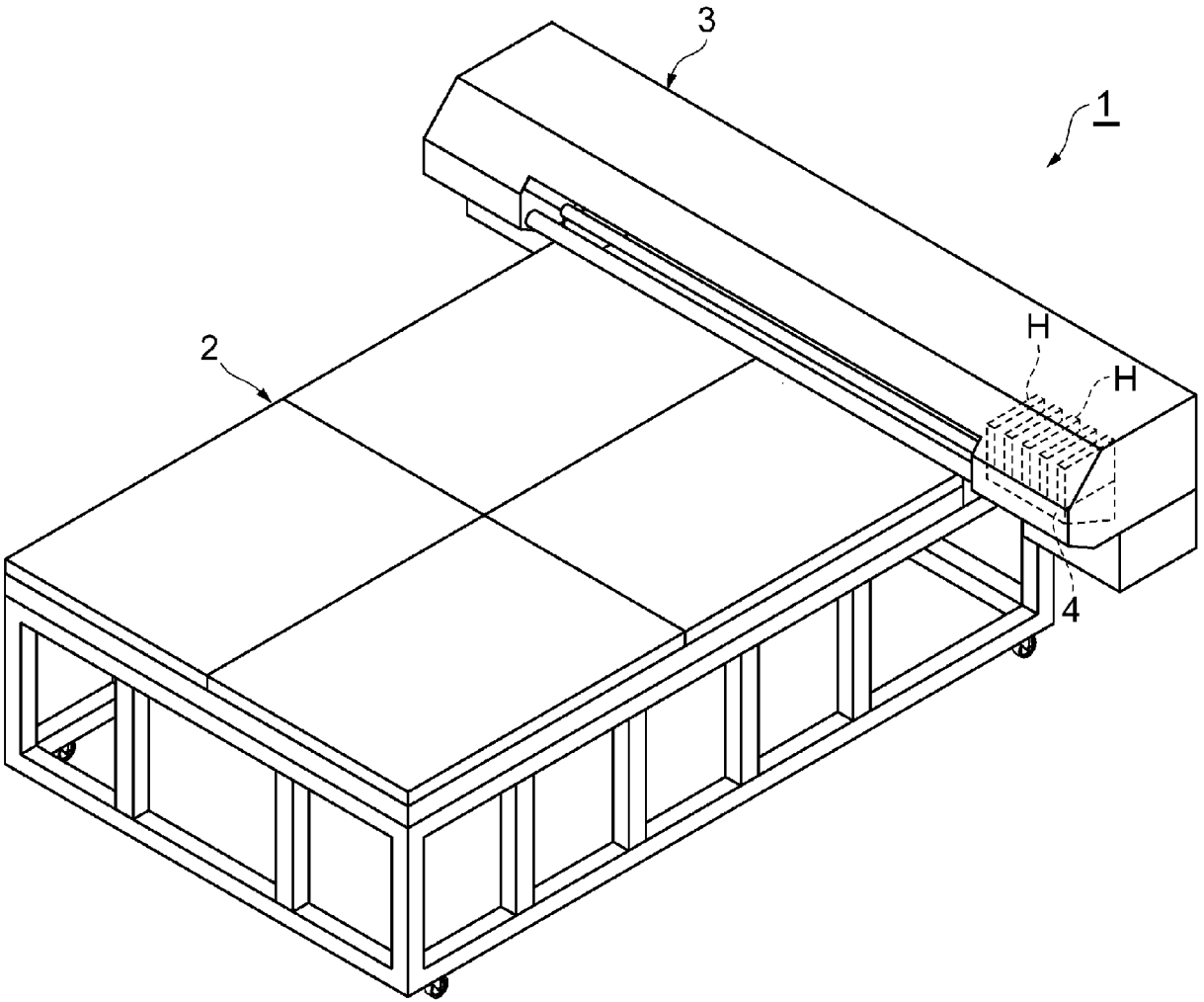
FIG. 1 is a perspective view showing an outward appearance of an inkjet printer on which a flushing unit is mounted in accordance with an embodiment of the present invention.

The embodiments will now be described with reference to the accompanying drawings, wherein like reference numerals designate corresponding or identical elements throughout the various drawings.

In the drawings, the same or corresponding portions are indicated with the same reference signs. Further, in the following description, the words such as "upper", "lower", "right", "left", "front" and "rear" correspond to an upper and lower direction, a right and left direction, and a front and rear direction in an inkjet printer.

A flushing unit in accordance with an embodiment of the present invention is mounted on an inkjet printer. FIG. 1 is a perspective view showing an outward appearance of an inkjet printer on which a flushing unit is mounted in accordance with an embodiment of the present invention. As shown in FIG. 1, the inkjet printer 1 is, for example, a flat bed type inkjet printer, which is provided with a stage part 2 on which a medium to be printed is placed and a printing unit 3 on which inkjet heads "H" for ejecting ink droplets are mounted. In the inkjet printer 1, a flushing unit 4 is provided on one end side (right side) of the printing unit 3.

Figure 2:
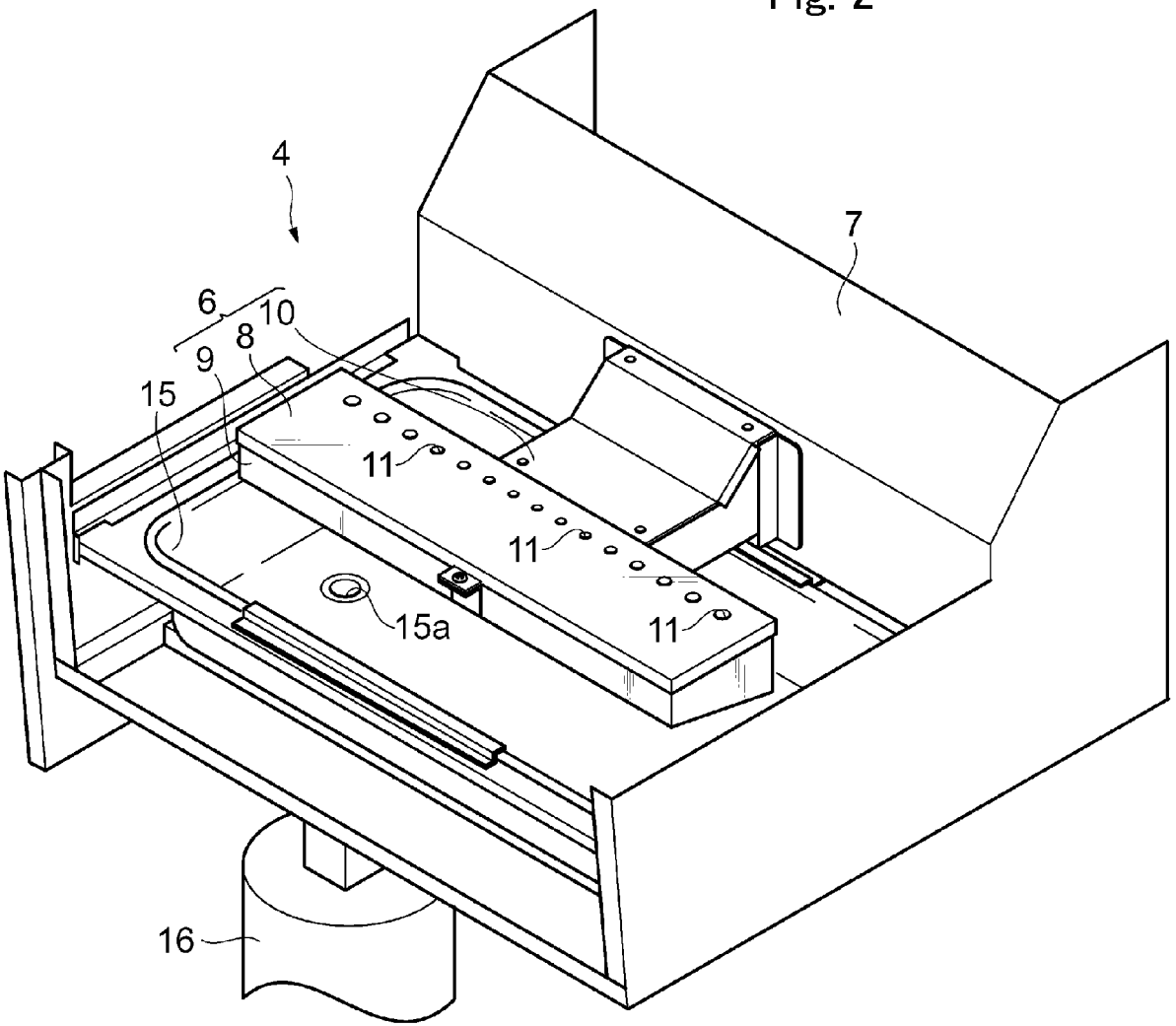
FIG. 2 is a perspective view showing a flushing unit.
Figure 3:
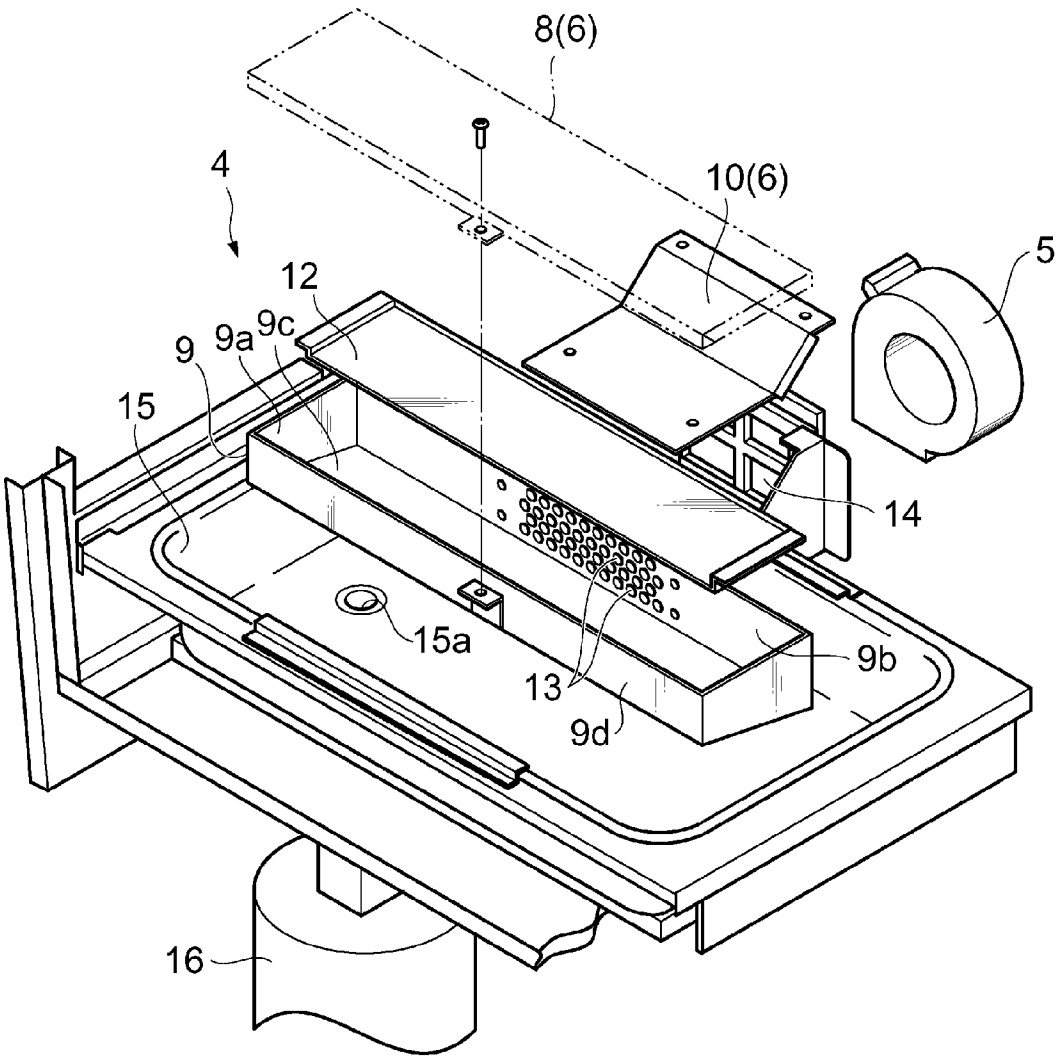
FIG. 3 is an exploded perspective view showing the flushing unit in FIG. 1.
Figure 4:
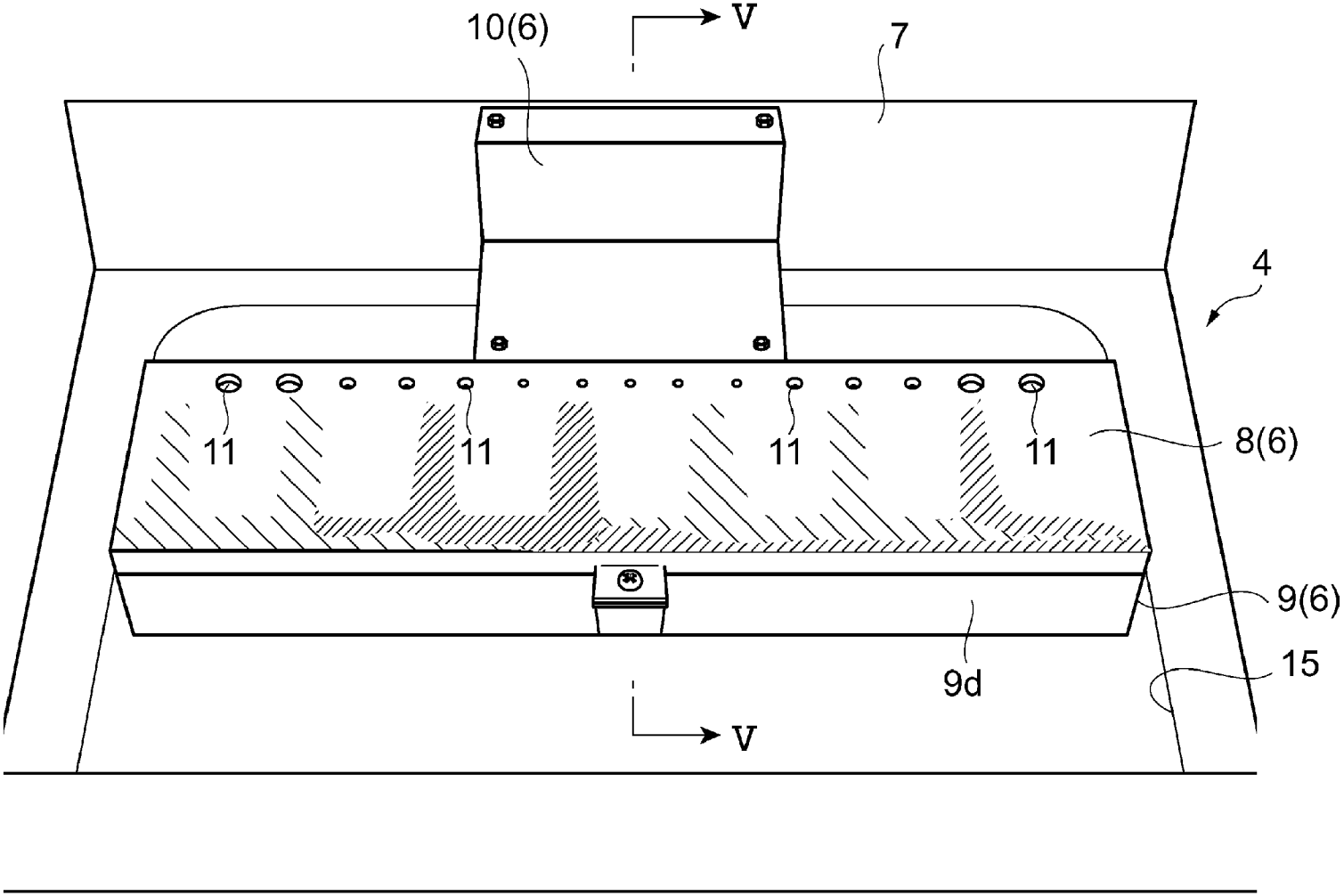
FIG. 4 is a front view showing the flushing unit in FIG. 1.
Figure 5:
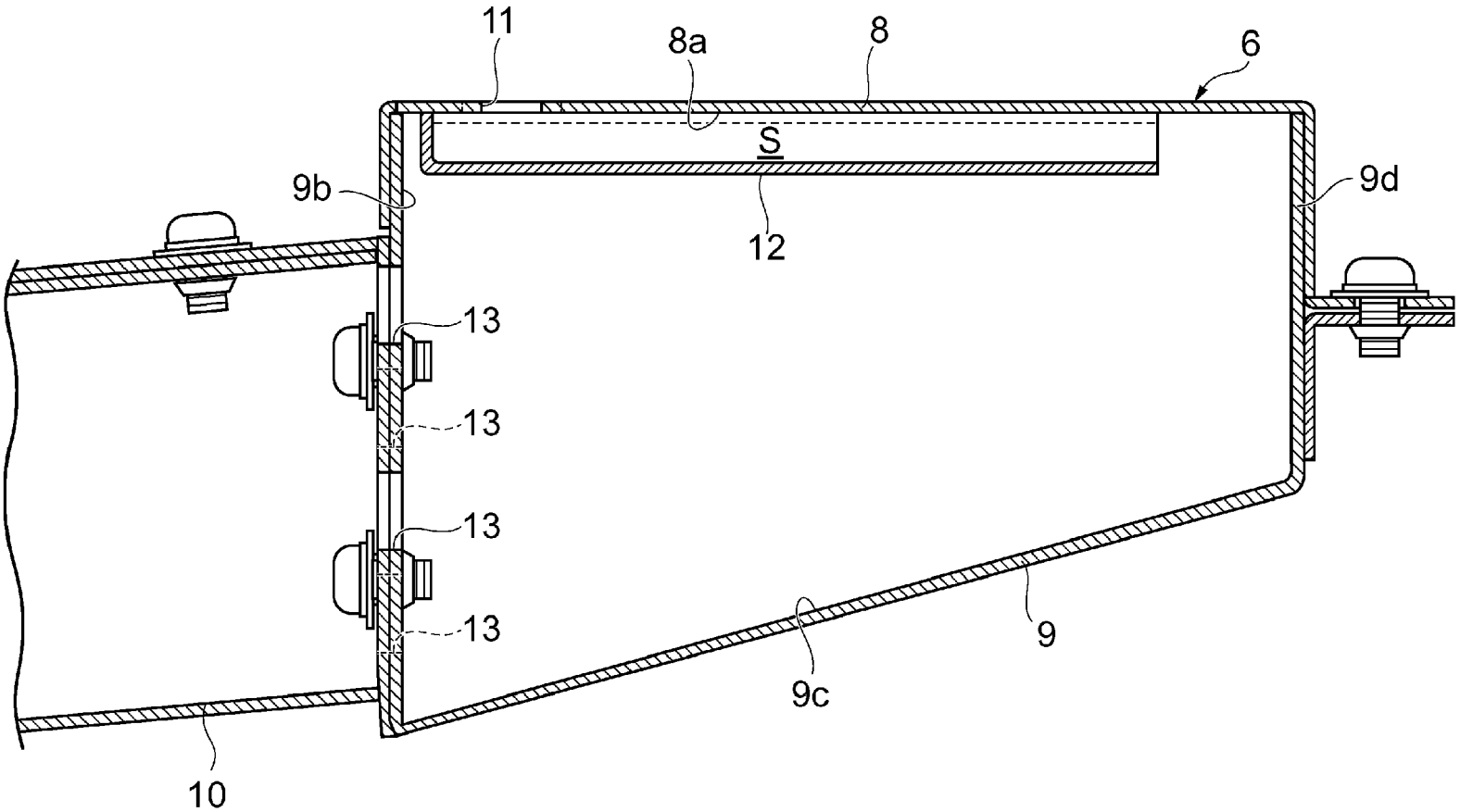
FIG. 5 is a cross-sectional view showing the flushing unit which is cut by the "V-V" line in FIG. 4.

Next, the flushing unit 4 will be described in detail below. FIG. 2 is a perspective view showing the flushing unit 4 and FIG. 3 is an exploded perspective view showing the flushing unit 4 in FIG. 2. FIG. 4 is a front view showing the flushing unit 4 in FIG. 2 and FIG. 5 is a cross-sectional view showing the flushing unit 4 which is cut by the "V-V" line in FIG. 4.

As shown in FIGS. 2 through 5, the flushing unit 4 is structured of a fan 5 and an ink mist collecting mechanism 6. The flushing unit 4 is an unit for collecting ink mist generated in a flushing processing in which ink is ejected from a nozzle (not shown) except the time of an image printing at a standby time of the inkjet head "H".

The fan 5 is a suction mechanism for sucking the ink mist. The fan 5 is, for example, a sirocco fan (multi-blade fan) and is disposed on an inner side of a cover part 7 in the printing unit 3. The fan 5 is connected with a power source not shown and is always operated regardless of an operation of a flushing processing.

The ink mist collecting mechanism 6 is a mechanism for collecting ink mist by a suction force of the fan 5. The ink mist collecting mechanism 6 is formed in a box-like shape and is closely disposed at a position facing the nozzle faces of the inkjet heads "H" at a standby time when the inkjet heads "H" do not perform an image printing or the like (at a position on the right side of the printing unit 3). The ink mist collecting mechanism 6 is provided with an upper face part 8, a tray part 9 and a duct part 10.

The upper face part 8 is a portion to which inks ejected the nozzles are dropped in the flushing processing. The upper face part 8 is provided with a plurality of suction holes 11 (fifteen holes in this embodiment) for sucking ink mist to the inside of the ink mist collecting mechanism 6 by a suction force of the fan 5. The plurality of the suction holes 11 is formed in the upper face part 8 along one end part (rear end part) on a side where the fan 5 is arranged. A diameter of the suction hole 11 becomes larger toward both end parts from the center part of the upper face part 8 (see FIG. 4). In this embodiment, the meaning of "larger toward both end parts from the center part of the upper face part 8" includes, as shown in FIG. 4, a diameter of a plurality of suction holes 11 having the same diameter may gradually become larger from the center part toward both end parts (in other words, five suction holes 11 disposed at the center part have the same diameter, six suction holes 11 disposed on both sides have respectively the same larger diameter, and four suction holes 11 disposed on further both sides have respectively the same further larger diameter. Alternatively, suction holes 11 adjacent to each other may gradually become larger (one by one) from the center part toward both end parts.

Further, the upper face part 8 is, as shown in FIG. 3, provided with a droplet forming member 12 at a position corresponding to a plurality of the suction holes 11. The droplet forming member 12 is a plate-shaped member for forming ink mist sucked through a plurality of the suction holes 11 into droplets. A length dimension of the droplet forming member 12 has a size equivalent to a length dimension of the upper face part 8 and its width dimension is set to be smaller than a width dimension of the upper face part 8 (about 10 mm). Further, the droplet forming member 12 is, as shown in FIG. 5, formed in a substantially "L"-shape in its cross section in a widthwise direction. The droplet forming member 12 having the structure as described above is, as shown in FIG. 5, disposed between connection holes 13 (described later) of the tray part 9 and the suction holes 11. The droplet forming member 12 is attached on an under side of the suction holes 11 and on a rear end side of the upper face part 8 so that a space "S" which is in communication with the suction holes 11 and is closed on its rear end side (left side in the drawing) and is opened on its front end side (right side in the drawing) is formed between the upper face part 8 and the droplet forming member 12.

The tray part 9 is a portion which forms a suction passage for ink mist by the fan 5. The tray part 9 is formed in a box-like shape having a trapezoid shape in cross section and is provided with an opening part 9*a* which is opened toward the upper side. The opening part 9*a* is closed by the upper face part 8. A plurality of the connection holes 13 is provided at the center portion of the side face 9*b* in the longitudinal direction of the tray part 9. In addition, a duct part 10 is connected with the side face 9*b* of the tray part 9 at a portion corresponding to the connection holes 13 (substantially center part of the tray part 9). Further, a bottom face part 9*c* of the tray part 9 is inclined downward to the rear side. One end part (inclined side) of the bottom face part 9*c* of the tray part 9 is provided with a discharge port (not shown) for discharging the ink which is collected in the tray part 9.

Figure 6:
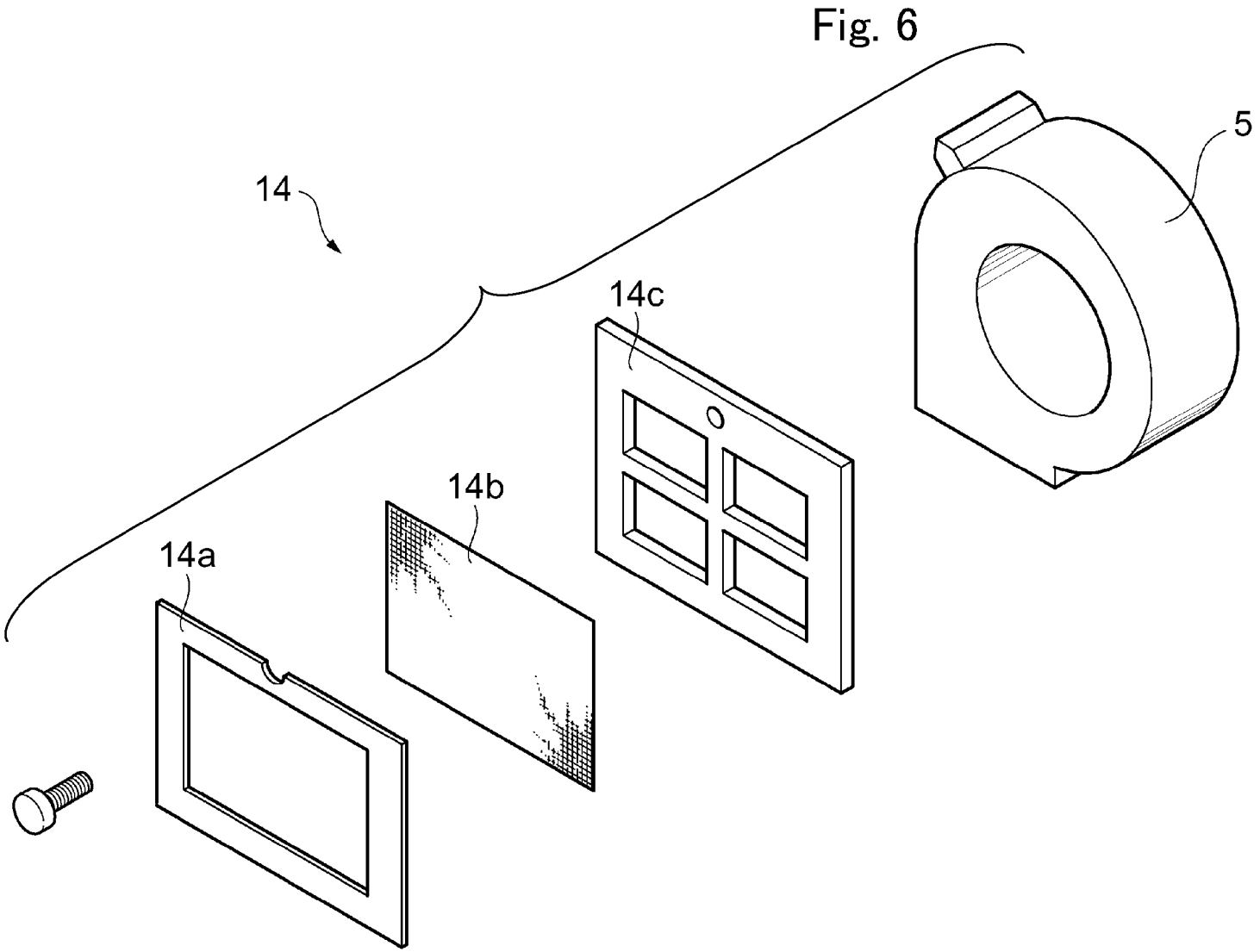
FIG. 6 is an exploded perspective view showing a structure of a filter.

The duct part 10 is a portion which connects the tray part 9 with the fan 5. One end part of the duct part 10 is connected with the side face 9*b* which corresponds to the connection holes 13 of the tray part 9 as described above. The other end part of the duct part 10 is connected with a side face of the cover part 7 which corresponds to a position where the fan 5 is disposed. Further, a filter 14 is provided between the fan 5 and the duct part 10. The filter 14 is, as shown in FIG. 6, provided with a frame part 14*a*, a filter part 14*b* and a fixing part 14*c*. The frame part 14*a* and the fixing part 14*c* are, for example, made of metal such as iron, and the filter part 14*b* is, for example, made of non-woven fabric. The filter 14 is structured so that the filter part 14*b* is sandwiched between the frame part 14*a* and the fixing part 14*c* and is fastened, for example, with a screw. In the filter 14, ink mist is stuck to the filter part 14*b* to be collected. In this embodiment, the filter 14*b* is replaceable.

The ink mist collecting mechanism 6 having the structure as described above is held so that the upper face part 8 and the nozzle faces of the inkjet heads "H" are separated from each other with a fixed distance (gap space) at the time of a flushing processing. Further, in the flushing unit 4, when the fan 5 is operated, a suction force is generated in a plurality of the suction holes 11 of the upper face part 8 of the ink mist collecting mechanism 6 through the tray part 9 and the duct part 10. Therefore, ink mist occurred by the flushing processing is sucked into the inside of the ink mist collecting mechanism 11 through a plurality of the suction holes 11.

Further, an ink tray 15 is provided on an under side of the ink mist collecting mechanism 6. The ink tray 15 is a portion which stores ink dropped from the upper face part 8 of the ink mist collecting mechanism 6 and the tray part 9. A discharge port 15*a* for discharging stored ink is provided in a bottom face part of the ink tray 15. The discharge port 15*a* is extended to an under side of the printing unit 3 and a valve (not shown) is provided for adjusting discharge of ink in the inside of the ink tray 15. Further, a tank 16 is detachably connected with a tip end part of the discharge port 15*a*. According to this structure, ink which is stored in the ink tray 15 is discharged to the tank 16 through the discharge port 15*a* by adjusting the valve and is discarded.

Next, a step in which ink mist is formed into droplets in the ink mist collecting mechanism 6 will be described below with reference to FIG. 7. FIGS. 7A and 7B are views schematically showing airflow generated by the fan 5. However, FIGS. 7A and 7B show only an example and thus a case different from the flow shown in FIGS. 7A and 7B may be occurred according to change of a condition such as a suction force of the fan 5.

Figure 7B:
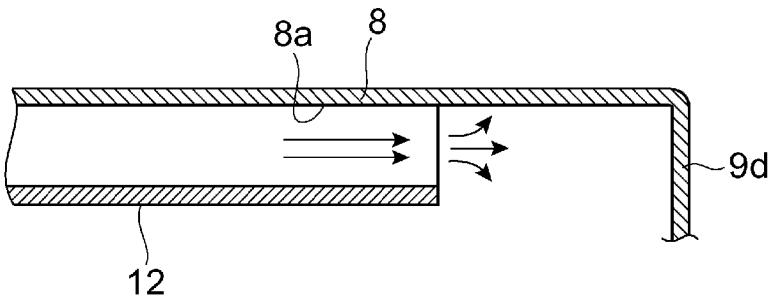
FIGS. 7A and 7B are views schematically showing airflow generated by a fan.
Figure 7A:
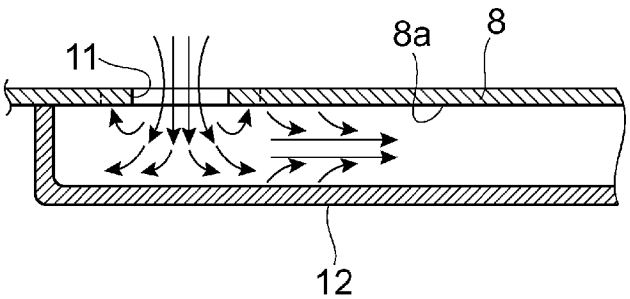

As shown in FIG. 7A, first, ink mist is sucked through the suction hole 11 by a suction force of the fan 5. In this case, a flowing speed at a center part is faster than that at an edge part in the suction hole 11 and a relative pressure at the edge part is higher than that at the center part. Therefore, the ink mist is concentrated and coupled to each other at the center part of the suction hole 11 to be formed into a droplet. In addition, the ink mist sucked through the suction hole 11 is formed into a droplet by being collided with the droplet forming member 12.

Further, when the ink mist is sucked through the suction hole 11, a vortex flow swirling upward is occurred on a back face 8*a* side of the upper face part 8 in the vicinity of the edge part of the suction hole 11. As a result, the ink mist is collided with the back face 8*a* of the upper face part 8 and thus the ink mist is formed into a droplet.

In addition, in the space "S" formed by the back face 8*a* of the upper face part 8 and the droplet forming member 12, a speed at the center part becomes faster than those on both side face sides and relative pressures on both side face sides become higher than that at the center part. As a result, the ink mist advancing the space "S" which is sucked through the suction hole 11 and is bent to the opened side (right side in the drawing) by the droplet forming member 12 is concentrated and coupled to each other at the center part of the space "S". The coupled ink mist is dropped downward by its own weight and is collided with the droplet forming member 12 to be formed into a droplet. Further, since the space between the upper face part 8 and the droplet forming member 12 is set to be narrow (for example, about 4 mm), a turbulent flow is occurred between the upper face part 8 and the droplet forming member 12, in other words, in the space "S". Therefore, the ink mist is collided with the upper face part 8 and the droplet forming member 12 and thus the ink mist is formed into a droplet.

A flow velocity of the ink mist which has been reached to an end part of the droplet forming member 12 is, as shown in FIG. 7B, decelerated by the side face 9*d* (side face opposite to the side face 9*b*) of the tray part 9. Therefore, since the ink mist stagnates near the side face 9*d* of the tray part 9, the preceding ink mist and the succeeding ink mist are collided with each other and thus the ink mist is formed into a droplet. Further, the ink mist is collided with the side face 9*d* of the tray part 9 to be formed into a droplet. The ink mist is formed into droplets in the inside of the ink mist collecting mechanism 6 through the steps as described above.

As described above, the flushing unit 4 is provided with the ink mist collecting mechanism 6 for collecting ink mist by a suction force of the fan 5. The ink mist collecting mechanism 6 is provided with the upper face part 8 on which inks ejected from the nozzles are dropped when a flushing processing is performed and in which a plurality of the suction holes 11 is provided for sucking ink mist into the inside of the ink mist collecting mechanism 6 by a suction force of the fan 5 and the droplet forming member 12 for forming the ink mist into droplets.

In the structure as described above, first, ink mist generated when inks are ejected from nozzles of the inkjet heads "H" are collided with the upper face part 8, which is disposed in the vicinity of the inkjet heads "H", and are formed into droplets. The ink mist which is not formed into droplets at this time and ink mist generated when the ink is collided with the upper face part 8 are sucked into the inside of the ink mist collecting mechanism 6 through a plurality of the suction holes 11 provided in the upper face part 8 by the fan 5. The ink mist sucked into the inside of the ink mist collecting mechanism 6 is formed into droplets by colliding with the droplet forming member 12 provided at the position corresponding to the suction holes 11 and the like. As described above, the ink mist generated at the time of a flushing processing is immediately formed into droplets after sucked through the suction holes 11 and thus the ink mist is collected at an early stage without being scattered in the printing unit 3 of the inkjet printer 1. Therefore, the ink mist is effectively collected and scattering of the ink mist can be restrained.

Further, in this embodiment, the fan 5 is connected with the side face 9*b* of the tray part 9 of the ink mist collecting mechanism 6 through the duct part 10 and a plurality of the suction holes 11 is provided along the end part in the upper face part 8 on the side face 9*b* side of the tray part 9 of the ink mist collecting mechanism 6. Further, the droplet forming member 12 is extended from the rear end side (side face 9*b* side) toward the front end side (side face 9*d* side) opposite to the rear end side between the connection holes 13 provided in the tray part 9 of the ink mist collecting mechanism 6 to which the fan 5 is connected and the suction holes 11 and the space "S" is formed which is in communication with the suction holes 11 and is closed on its rear end side and is opened on its front end side.

When this structure is adopted, a suction flow passage is formed so that, first, the ink mist sucked through the suction holes 11 is bent to the side face 9*d* side and, after that, the ink mist is bent to the fan 5 side at the end part on the front end side of the droplet forming member 12. As a result, as shown in FIGS. 7A and 7B, coupling of the ink mist is occurred in the space "S", which is formed between the upper face part 8 and the droplet forming member 12, due to collision of the ink mist with the droplet forming member 12 and the upper face part 8, collision of the ink mist with each other, and differences of flow velocities and pressures in the inside of the space "S". Further, a flow passage through which the ink mist sucked through the suction holes 11 is reached to the fan 5 can be secured long. Therefore, a colliding area (region) of the ink mist with the droplet forming member 12 and the upper face part 8 is increased in the space "S" and airflow suitable to form the ink mist into droplets is generated and thus the ink mist is further facilitated to be formed into droplets and the ink mist can be collected further effectively.

Further, the ink mist collecting mechanism 6 is disposed at a position facing the inkjet head "H" at a standby position of the inkjet head "H" and is held so that a distance between the upper face part 8 and the inkjet head "H" is constant and thus the suction force based on the distance between the upper face part 8 and the inkjet head "H" can be made uniform. Therefore, ink mist generated at the time of a flushing processing during a standby time of the inkjet head "H" can be collected surely.

Further, the filter 14 to which ink mist is stuck is provided between the fan 5 and the duct part 10 of the ink mist collecting mechanism 6. Therefore, the ink mist which is not formed into droplets by the droplet forming member 13 can be surely collected by the filter 14.

In this embodiment, a plurality of the connection holes 13 is provided in the side face 9*b* of the tray part 9 of the ink mist collecting mechanism 6. Therefore, the ink mist sucked by the fan 5 is formed into droplets by colliding with the portion around the connection holes 13 before reaching to the filter 14. As a result, since the ink mist stuck to the filter 14 can be reduced, the filter part 14*b* of the filter 14 is not required to be replaced frequently and thus the cost can be reduced.

The present invention is not limited to the above-mentioned embodiment. For example, in the embodiment described above, the droplet forming member 12 is formed in a substantially "L"-shape in cross section and is attached to the back face 8*a* of the upper face part 8. However, the present invention is not limited to this structure when the space "S" is formed between the upper face part 8 and the droplet forming member 12. For example, it may be structured that a plate-shaped member protruding from the side face 9*b* of the tray part 9 is provided so as to be substantially parallel to the upper face part 8 to form the space "S".

Further, in the embodiment described above, the fan 5 is used as the suction mechanism but another mechanism may be used.

Further, in addition to the embodiment described above, the surface on the suction hole side of the droplet forming member 12 may be formed in a projected and recessed structure such as a wave shape or a saw shape. Further, an absorbing body for absorbing ink may be provided on the bottom face part 9*c* of the tray part 9.

The embodiment of the present invention provides a flushing unit which is provided in an inkjet printer on which an inkjet head having a nozzle from which ink is ejected is mounted and which collects ink mist generated at a time of a flushing processing in which ink is ejected from the nozzle. The flushing unit includes a suction mechanism for sucking the ink mist and an ink mist collecting mechanism formed in a box-like shape for collecting the ink mist by a suction force of the suction mechanism. The ink mist collecting mechanism is provided with an upper face part on which the ink ejected from the nozzle is dropped and which is provided with a plurality of suction holes for sucking the ink mist into an inside of the ink mist collecting mechanism by the suction force of the suction mechanism, and a droplet forming member which is provided at a position corresponding to the plurality of the suction holes for forming the ink mist sucked through the plurality of the suction holes into droplets.

The flushing unit is provided with the box-shaped ink mist collecting mechanism for collecting ink mist by a suction force of the suction mechanism and the ink mist collecting mechanism is provided with the upper face part and the droplet forming member. In this structure, the ink mist generated at the time of a flushing processing is sucked into the inside of the ink mist collecting mechanism by the suction mechanism through a plurality of the suction holes provided in the upper face part. The ink mist which is sucked into the inside of the ink mist collecting mechanism is formed into droplets by being collided with the droplet forming member provided at a position corresponding to the suction holes and the like. As described above, the ink mist generated at the time of a flushing processing is sucked into the inside of the ink mist collecting mechanism to be immediately formed into droplets and thus the ink mist is collected without being scattered in the inside of the inkjet printer. Therefore, the ink mist is effectively collected and scattering of the ink mist is restrained.

Further, it is preferable that the suction mechanism is connected to one side face side of the ink mist collecting mechanism, the plurality of the suction holes is provided in the upper face part along an end part on the one side face side of the ink mist collecting mechanism, the droplet forming member is disposed between a connection hole of the ink mist collecting mechanism with which the suction mechanism is connected and the suction holes, and a space is formed which is in communication with the suction holes and in which the one side face side is closed and the other side face side facing the one side face side is opened. In this case, a suction flow passage is formed so that, first, ink mist sucked through the suction holes is bent to the other side face side and, after that, the ink mist is bent to the one side face side (suction mechanism side) at the end part of the droplet forming member. Therefore, coupling of the ink mist is occurred in the space which is formed between the upper face part and the droplet forming member due to collision of the ink mist with the droplet forming member and the upper face part, collision of the ink mist with each other, and differences of flow velocities and pressures in the inside of the space. Further, a flow passage through which the ink mist sucked through the suction holes is reached to the suction mechanism can be secured long. Therefore, a colliding area (region) of the ink mist with the droplet forming member and the upper face part is increased in a predetermined space and airflow suitable to form the ink mist into droplets is generated and thus the ink mist is further facilitated to be formed into droplets and is collected further effectively.

Further, it is preferable that the ink mist collecting mechanism is disposed at a position facing the inkjet head at a standby position of the inkjet head, and the ink mist collecting mechanism is held so that a distance between the upper face part and the inkjet head is constant. In this case, the suction force based on the distance between the upper face part and the inkjet head "H" can be uniformed.

Further, it is preferable that the suction mechanism is connected with a substantially center part on the one side face side of the ink mist collecting mechanism, and the plurality of the suction holes is formed so that diameters of the suction holes become larger toward both end parts from a center part of the upper face part. A suction force for the ink mist in the suction hole is larger at a position nearer to the suction mechanism. Further, a suction amount through the suction hole becomes larger as its diameter becomes larger. In this embodiment, since the suction mechanism is connected with a substantially center part on the one side face side of the ink mist collecting mechanism and the diameter of the suction hole is set to be larger as the suction hole is separated from the suction mechanism, a suction force for the ink mist in the upper face part can be made uniform.

Further, it is preferable that a filter to which the ink mist is stuck is provided between the suction mechanism and the ink mist collecting mechanism. In this case, the ink mist which is not formed into droplets by the droplet forming member can be surely collected by the filter.

Further, it is preferable that a bottom face part of the ink mist collecting mechanism is inclined. In this case, the ink which is formed into droplets by the droplet forming member is accumulated on one end side of the bottom face part of the ink mist collecting mechanism and thus the ink accumulated in the ink mist collecting mechanism can be preferably discharged.

According to the embodiment of the present invention, the ink mist is collected effectively and scattering of the ink mist is restrained.

Obviously, numerous modifications and variations of the present invention are possible in light of the above teachings. It is therefore to be understood that within the scope of the appended claims, the invention may be practiced otherwise than as specifically described herein.

What is claimed is:

1. A flushing apparatus for an inkjet printer, comprising:

a suction mechanism to suck ink mist generated at a time of a flushing processing in which ink is ejected from a nozzle provided in an inkjet head of the inkjet printer; and an ink mist collecting mechanism to collect the ink mist by a suction force of the suction mechanism, the ink mist collecting mechanism having a box-shaped housing, the ink mist collecting mechanism comprising:

an upper face part on which the ink ejected from the nozzle is dropped, the upper face part including a plurality of suction holes through which the ink mist is sucked into an inside of the ink mist collecting mechanism by the suction force of the suction mechanism; and a droplet forming member provided in an interior of the box-shaped housing at a position beneath the plurality of the suction holes to form droplets from the ink mist sucked through the plurality of the suction holes, wherein the suction mechanism is connected to the interior via a connection hole provided on a first side face of the ink mist collecting mechanism, wherein the plurality of the suction holes is provided in the upper face part at a location adjacent to the first side face, wherein the droplet forming member is disposed between the suction holes and the connection hole, and wherein the droplet forming member defines a space in communication with the plurality of suction holes, the space being closed on an end adjacent the first side face and opened on an opposite end adjacent a second side face of the ink mist collecting mechanism, the second side face being opposite to the first side face.

2. The flushing apparatus according to claim 1, wherein a bottom face part of the ink mist collecting mechanism is inclined.

3. The flushing apparatus according to claim 1, wherein the ink mist collecting mechanism is disposed to face the inkjet head provided at a standby position of the inkjet head, and the ink mist collecting mechanism is held so that a distance between the upper face part and the inkjet head is constant.

4. The flushing apparatus according to claim 3, wherein the suction mechanism is connected with a substantially center part on the first side face side of the ink mist collecting mechanism, and the plurality of the suction holes is formed so that diameters of the suction holes become larger toward both end parts from a center part of the upper face part.

5. The flushing apparatus according to claim 4, further comprising:

a filter to which the ink mist is stuck, the filter being provided between the suction mechanism and the ink mist collecting mechanism.

6. The flushing apparatus according to claim 5, wherein a bottom face part of the ink mist collecting mechanism is inclined.

7. The flushing apparatus according to claim 1, wherein the suction mechanism is connected with a substantially center part on the first side face side of the ink mist collecting mechanism, and the plurality of the suction holes is formed so that diameters of the suction holes become larger toward both end parts from a center part of the upper face part.

8. The flushing apparatus according to claim 7, further comprising:

a filter to which the ink mist is stuck, the filter being provided between the suction mechanism and the ink mist collecting mechanism.

9. The flushing apparatus according to claim 8, wherein a bottom face part of the ink mist collecting mechanism is inclined.

10. The flushing apparatus according to claim 1, further comprising:

a filter to which the ink mist is stuck, the filter being provided between the suction mechanism and the ink mist collecting mechanism.

11. The flushing apparatus according to claim 10, wherein a bottom face part of the ink mist collecting mechanism is inclined.

12. The flushing apparatus according to claim 3, further comprising:

a filter to which the ink mist is stuck, the filter being provided between the suction mechanism and the ink mist collecting mechanism.

13. The flushing apparatus according to claim 12, wherein a bottom face part of the ink mist collecting mechanism is inclined.

14. The flushing apparatus according to claim 1, wherein the droplet forming member is a plate-shaped member that extends beneath the upper face part from the end adjacent the first side face to the opposite end adjacent the second side face.

* * * * *